United States Patent [19]

Rabley

[11] 4,138,015

[45] Feb. 6, 1979

[54] STORAGE TRAY ASSEMBLY

[75] Inventor: Derek S. Rabley, London, England

[73] Assignee: M. Myers & Son Limited, West Midlands, England

[21] Appl. No.: 806,851

[22] Filed: Jun. 15, 1977

[30] Foreign Application Priority Data

Jun. 18, 1976 [GB] United Kingdom ..... 25313/76

[51] Int. Cl.[2] ..... B42F 7/12; B42F 17/12

[52] U.S. Cl. ..... 206/561; 206/821; 211/126

[58] Field of Search ..... 206/449, 510–512, 206/553, 561, 821; 211/41, 126, 128, 186, 188, 194; 312/111, 257 R, 257 A; 108/53, 91, 101, 154

[56] References Cited

U.S. PATENT DOCUMENTS

| | | | |
|---|---|---|---|
| 2,894,640 | 7/1959 | Bigelow | 211/126 |
| 3,533,512 | 10/1970 | Serwer | 211/126 |
| 3,581,906 | 6/1971 | Joyce | 211/126 |

*Primary Examiner*—Steven E. Lipman
*Attorney, Agent, or Firm*—Holman & Stern

[57] ABSTRACT

A storage tray assembly comprising at least two separate trays of rectangular form together with at least two pairs of sidewall members which are of similar form and of L-shaped configuration, said sidewall members being arranged so that their lower portions can engage the upper part of one tray and their upper portions can engage the lower part of another tray so as to connect said trays together in a vertically spaced relationship, each tray having in its upper surface slot means which extend along each of two opposite lateral sides of the tray and at least partially along one of the other sides so as to be adapted to receive the lower portions of two of said L-shaped sidewall members, and having in its lower surface further slot means which extend along each of said two opposite lateral sides and at least partially along each of the other two sides so as to be adapted to receive the upper portions of two further L-shaped sidewall members so that a tray can be disposed relative to the pair of sidewall members beneath it in either of two alternative positions which are obtained by turning the tray through 180° about a vertical axis.

5 Claims, 3 Drawing Figures

STORAGE TRAY ASSEMBLY

This invention relates to a storage tray assembly such as may be used for the storing of documents or papers of various kinds and other articles, the object of the invention being to provide such a storage tray assembly in an improved form.

In accordance with the invention there is provided a storage tray assembly which comprises two or more separate trays which each include a base portion of generally rectangular form, together with a least two pairs of sidewall members which are of similar form and of L-shaped configuration, said sidewall members being arranged so that their lower portions can engage the upper part of one tray and their upper portions can engage the lower part of another tray so as to connect said trays together in a vertically spaced relationship, each of said trays being formed in its upper surface with slot means which extend along each of two opposite lateral sides and at least partially along one of the other sides so as to be adapted to receive the lower portions of two of said L-shaped sidewall members, and being formed in its lower surface with slot means which extend along each of said two opposite lateral sides and at least partially along each of the other two sides so as to be adapted to receive the upper portions of two further L-shaped sidewall members whereby a tray can be disposed relative to the pair of sidewall members beneath it in either of two alternative positions which are obtained by turning the tray through 180° about a vertical axis.

Conveniently, said trays and said sidewall members are each formed as a one-piece moulding in a synthetic resin material but preferably the trays are formed in a material having a colour which is different from the colour of the sidewall member material and in one preferred form the latter material is transparent or translucent to aid sight of articles stored in the assembly. Furthermore each sidewall member may be provided on one surface with a pair of spaced parallel guide marks or spaced parallel outwardly projecting ribs which extend along the length of the spacer member and which serve to indicate when said member is in the correct position in the tray slot means.

Figure 1:
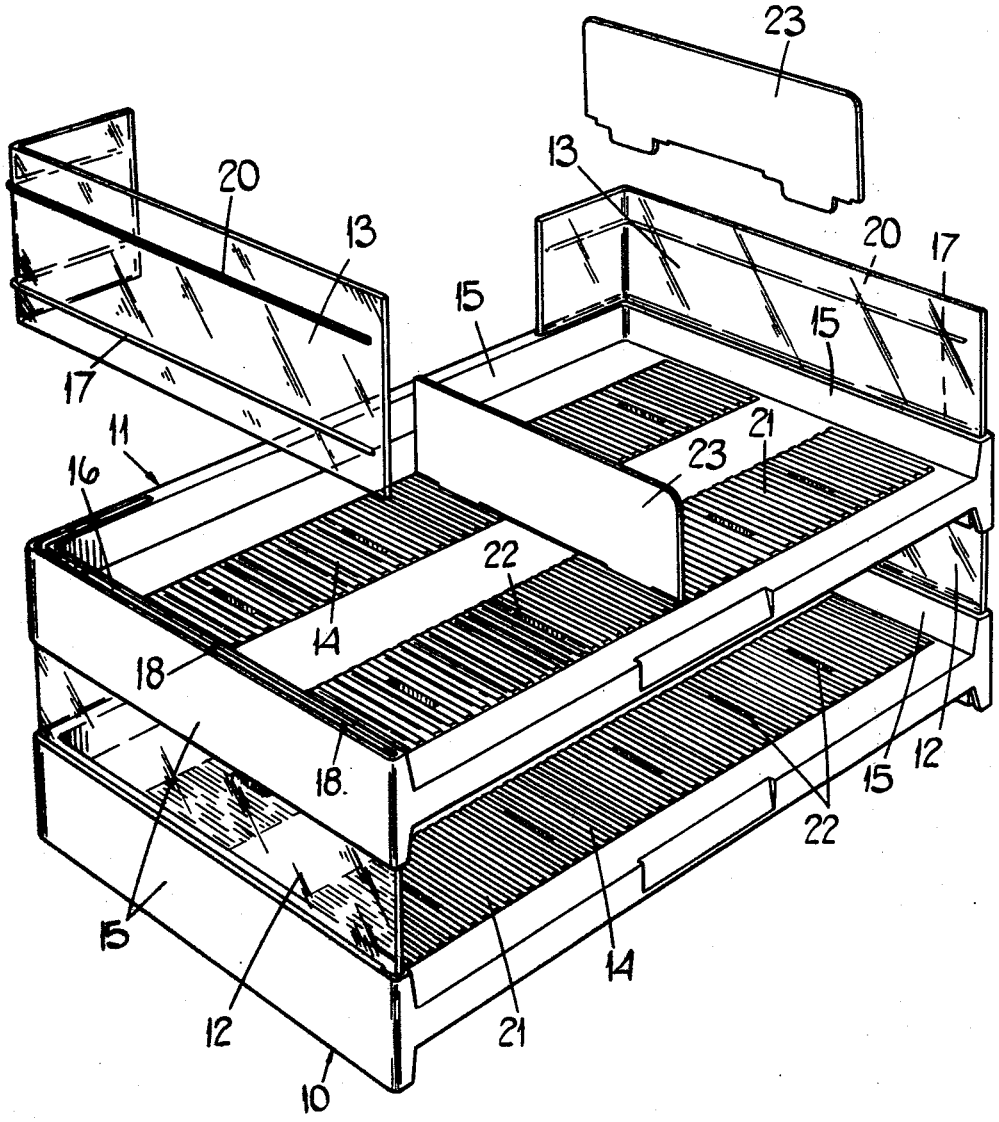
Figure 2:
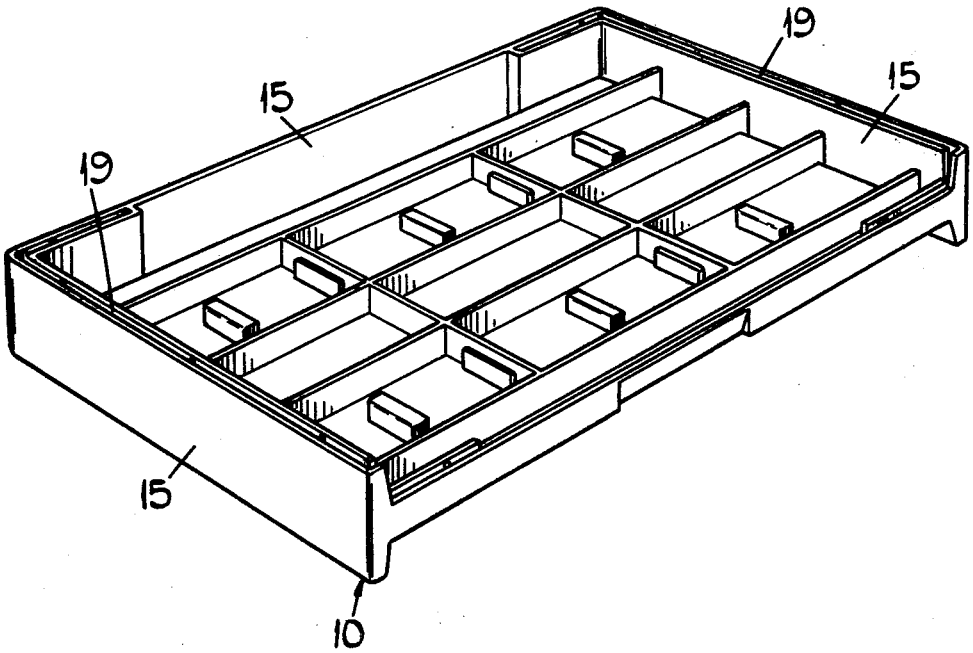
Figure 3:
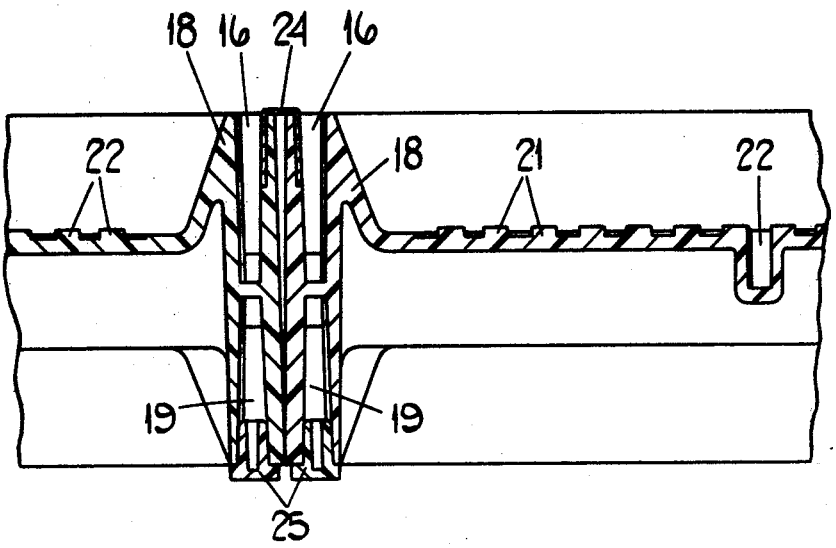

The invention will now be more particularly described with reference to the accompanying drawings wherein:

FIG. 1 is a perspective view, partially "exploded", of one example of a storage tray assembly in accordance with the invention, FIG. 2 is a perspective view from underneath of one of the trays forming part of the assembly seen in FIG. 1, and FIG. 3 is a fragmentary composite sectional view in a vertical plane illustrating how two trays can be connected together in a side by side relation when it is required to form a bank of assemblies, the section being taken through the centre of a side edge of each tray and thereafter through the base portion of each tray along a line which is offset from the longitudinal axis of the tray but parallel thereto so as to show the ribbing formed on the upper surface of this part of the tray.

Referring to the drawings, the storage tray assembly shown in FIG. 1 comprises two separate trays 10 and 11 and two pairs 12 and 13 of sidewall members. It is however to be understood that more than two trays can be provided if desired and in such cases there would be more than two pairs of sidewall members.

Each of said trays 10 and 11 is formed as a one piece moulding from a synthetic resin material of any desired colour and includes a base portion 14 of generally rectangular form. There is also provided a wall portion 15 which is integrally connected to said base portion and which extends around three of the four edges thereof. Said wall portion also projects as shown from each of the two opposite faces of said base portion, i.e. it projects both upwardly and downwardly from the base portion when the tray is being used.

Each of the aforesaid trays will be disposed when the storage tray assembly is made up so that the base portion 14 of the tray extends in a horizontal plane and that edge of each base portion which is not integrally connected to a part of the wall portion 15 wil form an open edge which will hereinafter be referred to as the front of the tray. Thus papers or other articles which are in use to be stored on a tray 10 or 11 will be laid on the upper surface of the base portion by passing them across the front of the tray.

As above mentioned there is provided in the construction shown two pairs 12 and 13 of sidewall members and all of said members are identical being formed as a one piece moulding in a synthetic resin material which is preferably transparent or translucent. Furthermore each sidewall member is of generally L-shaped configuration when viewed in plan so that it has two integrally connected flanges which extend in mutually perpendicular planes and in use each of said flanges will lie in a vertical plane, there being one pair (namely the pair 12) of such sidewall members between each pair of adjacent trays which, in the completed assembly, will be arranged in a vertically spaced relationship, and also one pair (namely the pair 13) of sidewall members which project above the topmost tray.

In the in situ upper surface of each tray there is formed on each side of the tray an L-shaped slot 16, the two slots thus formed corresponding in shape and size to the L-shaped configuration of said sidewall members 12 or 13. Thus the longer part of each L-shaped slot extends into the upper surface of one of the lateral portions of the wall portion 15 and the shorter portion of each slot extends partway into the upper surface of the rear part of said wall portion. A bottom tray (namely tray 10) can thus be laid on a desk or other horizontal supporting surface and two sidewall members 12 can then be inserted into the two L-shaped slots formed in the upper surface of said bottom tray 10. The correct depth of penetration of said sidewall members into the slots is denoted by means of a mark or a rib 17 which is integrally moulded into the sidewall member and which extends along the length thereof at a desired distance from one longitudinal edge, such rib projecting outwardly from the surface of the sidewall member. Furthermore, the slots 16 may be of inwardly tapered configuration in cross-section, the corresponding edge portions of the sidewall members being similarly tapered to ensure firm engagement between the trays and the sidewall members. As an optional feature to further enhance such firm engagement, the slots may also be provided with inwardly projecting splines or ribs 18 which will grip the sidewall members. The two sidewall members 12 will thus leave open the front of the bottom tray 10 as above defined whilst the shorter flanges of the spacer members will extend partway round the two rear corners of said tray. Alternatively, the slots and the sidewall members may be so arranged that their shorter flanges meet at their free ends or lie closely adjacent to each other.

The in situ lower surface of each tray is also formed as shown in FIG. 2 with a pair of slots 19 respectively arranged on the two opposite sides of the tray but in this case each of said lower slots 19 is of generally channel-shaped configuration. A second tray (such as tray 11) may therefore be assembled to the above-mentioned bottom tray 10 and pair of sidewall members 12 connected thereto by laying it on top of said sidewall members so that the upper portions of the latter enter the lower slots 19 formed in said second tray. Furthermore because said lower slots are channel-shaped configuration the second tray 11 may be arranged in one of two alternative positions obtained by rotating it through 180° about a vertical axis so that the front of the second tray 11 can face in the same direction as the front of the bottom tray (as shown in FIG. 1) or in a direction which is directly opposed to the direction in which said front of the bottom tray 10 faces. The assembly can then be continued to any desired height by adding further pairs of sidewall members and further trays. Each sidewall member is also provided with a second mark or projecting rib 20 which, like the first mentioned mark or rib 17, will serve to denote the correct depth of penetration of the upper portion of the sidewall member into the co-acting lower slot 19 of the tray immediately above.

If desired the base portion of each tray may be formed with ribs 21 and grooves or slots 22 designed to located partitions 23 which can be used to divide the area of said base portion into a plurality of compartments. Furthermore the lateral parts of the wall portion of each tray may be provided with recesses whereby two assemblies as above described can be connected together in a side by side relationship to form a bank of assemblies by using a clip 24 of inverted channel-shaped form (see FIG. 3) which enters into the recesses of adjacent trays to bridge them and hold them together. The lowermost tray 10 may also be provided with feet 25 made of rubber or other material which are arranged so that their upper ends are located in the lower slots 19 of said lowermost tray 10. Alternatively, to avoid having to remove such feet 25 from the lower slots 19 when a tray previously supplied with feet is to be used in a position in the assembly in which it is not the lowermost tray, said feet may be located in further recesses (not shown) separate from the slots 19.

In the above-described construction, the slots in the trays are formed as continuous slots in the wall portions of the trays. Alternatively, the sidewall members may be formed so that they each have a plurality of projecting flange portions which are then arranged to engage in a similar number of separate slots formed in each of the trays. Furthermore, the wall portions of the trays can be dispensed with in which case the slots would be formed in the base portions (which would be of suitable thickness) of the trays or alternatively the slots could be formed in channels or other separately formed sections which are connected to the trays.

I claim:

1. A storage tray combination comprising at least two separate trays of generally rectangular form and at least two separately formed sidewall members of L-shaped configuration, lower portions of the sidewall members being engageable with an upper part of one of said trays while upper portions of the sidewall members are engageable with a lower part of another of said trays so as to connect said trays together in a vertically spaced relationship, each of said trays having an upper surface defining slot means extending along each of two opposite lateral sides of the tray and at least partially along one of the other sides of the tray for receiving the lower portions of two of said L-shaped sidewall members and each of said trays having a lower surface defining further slot means extending along each of said two opposite lateral sides of the tray and at least partially along each of the other two sides of the tray for receiving the upper portions of two of said L-shaped sidewall members, whereby said trays can be arranged together in said vertically spaced relationship in either of two alternative positions obtained respectively by turning said one tray horizontally through 180° relative to said other tray and in each of which positions the trays are arranged in a vertically aligned relationship.

2. A storage tray combination as claimed in claim 1 wherein each sidewall member is provided with a pair of spaced parallel guide formations which serve to indicate when said member is in a required position in the slot means of a tray with which said sidewall member is engaged.

3. A storage tray combination as claimed in claim 1 wherein each tray includes a wall portion with lateral parts defining recesses adapted to receive clips for connecting together two or more of said storage tray assemblies in a side by side relationship.

4. A storage tray combination as claimed in claim 1 wherein each tray includes a wall portion which extends around three edges of the tray and said upper surface defining said slot means is an upper surface of said wall portion.

5. A storage tray combination as claimed in claim 4 wherein each tray includes a base portion and the wall portion of each tray projects below the base portion and wherein the further slot means formed in the lower surface of the tray comprise slots formed in the lower surface of the wall portion and in the underside of the base portion.

* * * * *